US010012129B2

(12) United States Patent
Bartolotta

(10) Patent No.: US 10,012,129 B2
(45) Date of Patent: Jul. 3, 2018

(54) MOTORCYCLE ENGINE COOLER

(71) Applicant: Franco Bartolotta, Hollywood, FL (US)

(72) Inventor: Franco Bartolotta, Hollywood, FL (US)

( * ) Notice: Subject to any disclaimer, the term of this patent is extended or adjusted under 35 U.S.C. 154(b) by 0 days.

(21) Appl. No.: 15/260,653

(22) Filed: Sep. 9, 2016

(65) Prior Publication Data

US 2017/0074151 A1 Mar. 16, 2017

Related U.S. Application Data

(60) Provisional application No. 62/216,927, filed on Sep. 10, 2015.

(51) Int. Cl.
*F01P 1/02* (2006.01)
*F01P 5/06* (2006.01)

(52) U.S. Cl.
CPC ..... *F01P 1/02* (2013.01); *F01P 5/06* (2013.01); *F01P 2037/00* (2013.01); *F01P 2050/16* (2013.01)

(58) Field of Classification Search
CPC .. F01P 1/02; F01P 2001/023; F01P 2001/026; F01P 1/00; F01P 5/06; F01P 2050/16
See application file for complete search history.

(56) References Cited

U.S. PATENT DOCUMENTS 7,303,034 B1 * 12/2007 Knuth ..... B62J 99/00 180/68.1
2009/0272342 A1 * 11/2009 DuQuette ..... F01P 1/02 123/41.58
2010/0300791 A1 * 12/2010 Kern ..... B60K 5/1216 180/229
2011/0203862 A1 * 8/2011 McMillan ..... B60K 11/06 180/68.1
2012/0277951 A1 * 11/2012 Sandel ..... B62K 11/04 701/36

OTHER PUBLICATIONS

"Cyril Huze Post", Apr. 13, 2012 <http://cyrilhuzeblog.com/2012/04/13/jims-forceflow-cylinder-head-cooler/>.*
"Thunder Press", Sep. 14, 2015 ,http://thunderpress.net/motorcycle-reviews/forceflow-cylinder-head-cooler-twin-cam-chillin-2/2015/09/14.htm.*

* cited by examiner

*Primary Examiner* — Jacob Amick

(57) ABSTRACT

A device and method for cooling an air cooled motorcycle engine. A fan and a cover acting as a duct directs engine heat forward away from a rider when the motorcycle engine is hot and the motorcycle is stopped. When the motorcycle is in motion the fan is switched off and the passing air takes a reversed path and flows rearward over the engine fins cooling the engine.

3 Claims, 5 Drawing Sheets

MOTORCYCLE ENGINE COOLER

FIELD OF THE INVENTION

The present invention relates to air cooled motorcycle engines, and more particularly, to a device and method to cool the engine and dissipate waste heat away from the rider.

OTHER RELATED APPLICATIONS

The present application relates to U.S. Provisional Patent Application No. 62/216,927 filed on 10 Sep. 2015 titled "Motorcycle V-Twin Cooling Fan", which is hereby incorporated by reference.

DESCRIPTION OF THE RELATED ART

Several designs for auxiliary motorcycle engine coolers have been designed in the past. None of them, however, includes a fan that is operated when at a stop or at low speeds that directs heated air passing over the motor away from the rider.

Applicant believes that the closest reference corresponds to commercially available engine fans that force air over the fins of an air cooled motorcycle engine indiscriminately or where the heat can affect the driver. However, these differ from the present invention because the present device and method of use alter the airflow direction depending on the speed at which the motorcycle is moving.

Other devices related to motorcycle engine cooling provide for a number of more or less complicated features that fail to solve the problem in an efficient and economical way. None of these devices suggest the novel features of the present invention.

SUMMARY OF THE INVENTION

It is one of the main objects of the present invention to provide a way to protect a motorcycle rider from heat injury produced by the engine when the motorcycle is stopped or at low speed.

It is another object of this invention to provide a device to selectively direct airflow bi-directionally over the cooling fins of a motorcycle engine.

It is still another object of the present invention to provide an aftermarket or factory supplied accessory that can be added to a motorcycle engine to enhance ride comfort and safety.

It is yet another object of this invention to provide such a device and method of use that is inexpensive to manufacture, use and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
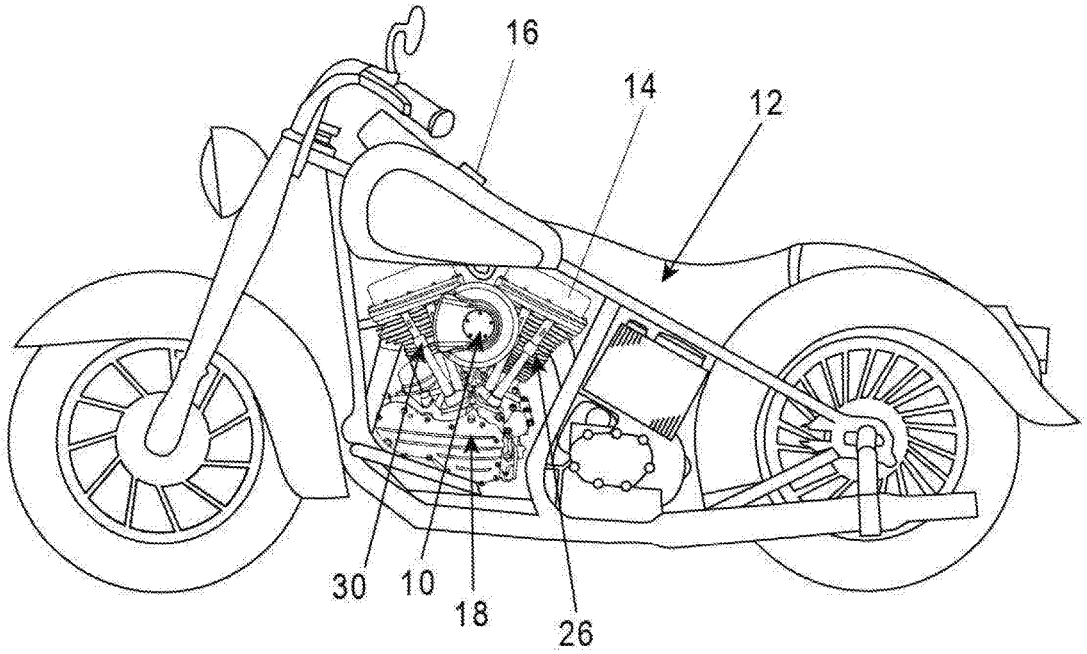
FIG. 1 shows an elevation view of a motorcycle cooler installed on a motorcycle.
Figure 2:
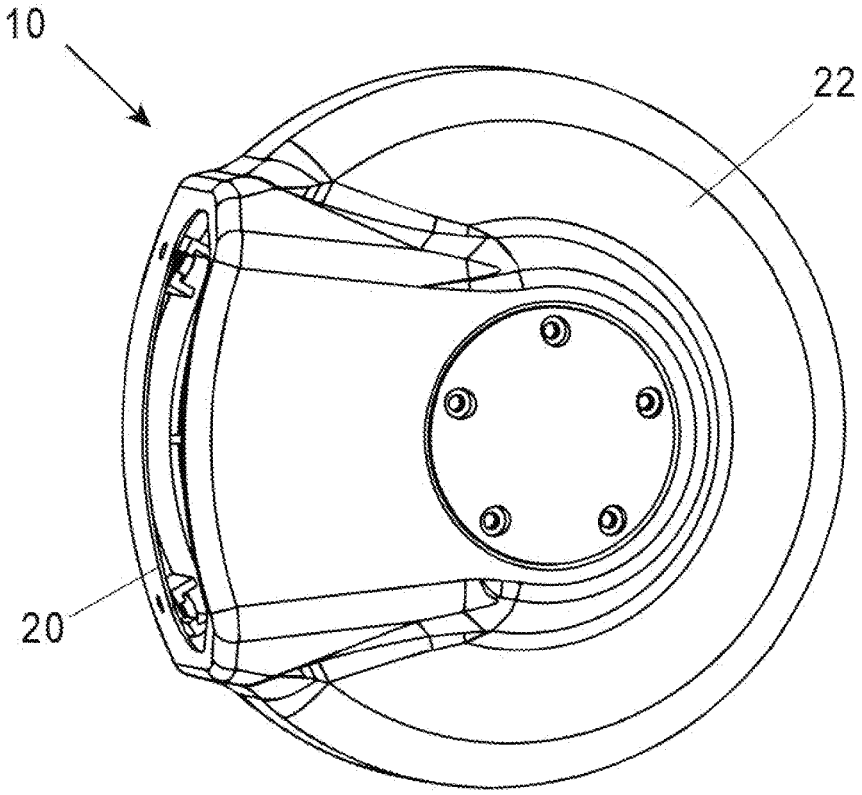
FIG. 2 shows a perspective view of a motorcycle cooler assembly apart from a motorcycle.
Figure 3:
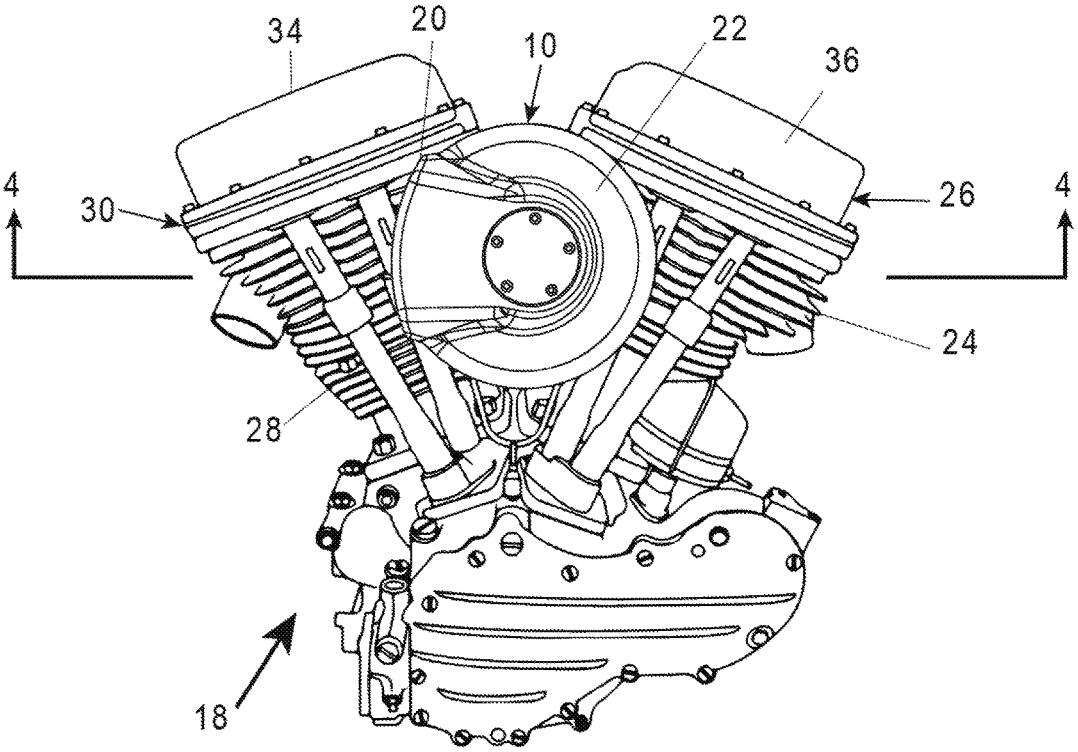
FIG. 3 shows a perspective view of a motorcycle cooler installed on motorcycle engine.

The subject device and method of use is sometimes referred to as the device, the invention, the motorcycle engine cooler, motorcycle cooler, fan, machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Many motorcycle engines are air cooled. As the bike is operated, air flows over a series of fins on the cylinder, the cylinder head and other parts of the engine. The heat from the engine is transferred to the air passing over the engine and is dissipated into the atmosphere. These types of engines cool more effectively when the motorcycle is moving and air rushes over the engine and cooling fins. The heat generated by the engine is blown away in the air path or wake of the motorcycle as it moves down the road at cruising speed.

At lower speeds or while the engine is running but the bike is not in motion the engine can become over heated. Further, if there is little or no air passing over the motor the heat generated by the motor is not dissipated into the atmosphere by the relative wind caused by a moving bike. Instead, when at rest with the engine running and generating heat, that heat emanating from the engine remains near the engine and the rider. This can cause the air around the bike and motor to become uncomfortably hot. The rider may even sustain burns on the legs.

Referring now to the drawings, where the present invention is generally referred to with numeral 10, it can be observed that it basically includes a motorcycle 12, a cylinder 14, a switch 16, a motor assembly 18, a port 20, a housing 22, fins 24, a cylinder assembly 26, fins 28, a cylinder assembly 30, an airflow path 32, a head 34, a head 36, a screen 38, a fan 40, a center 42, blades 44, a motor 46, a shaft 40 and a bracket 50.

Figure 5:
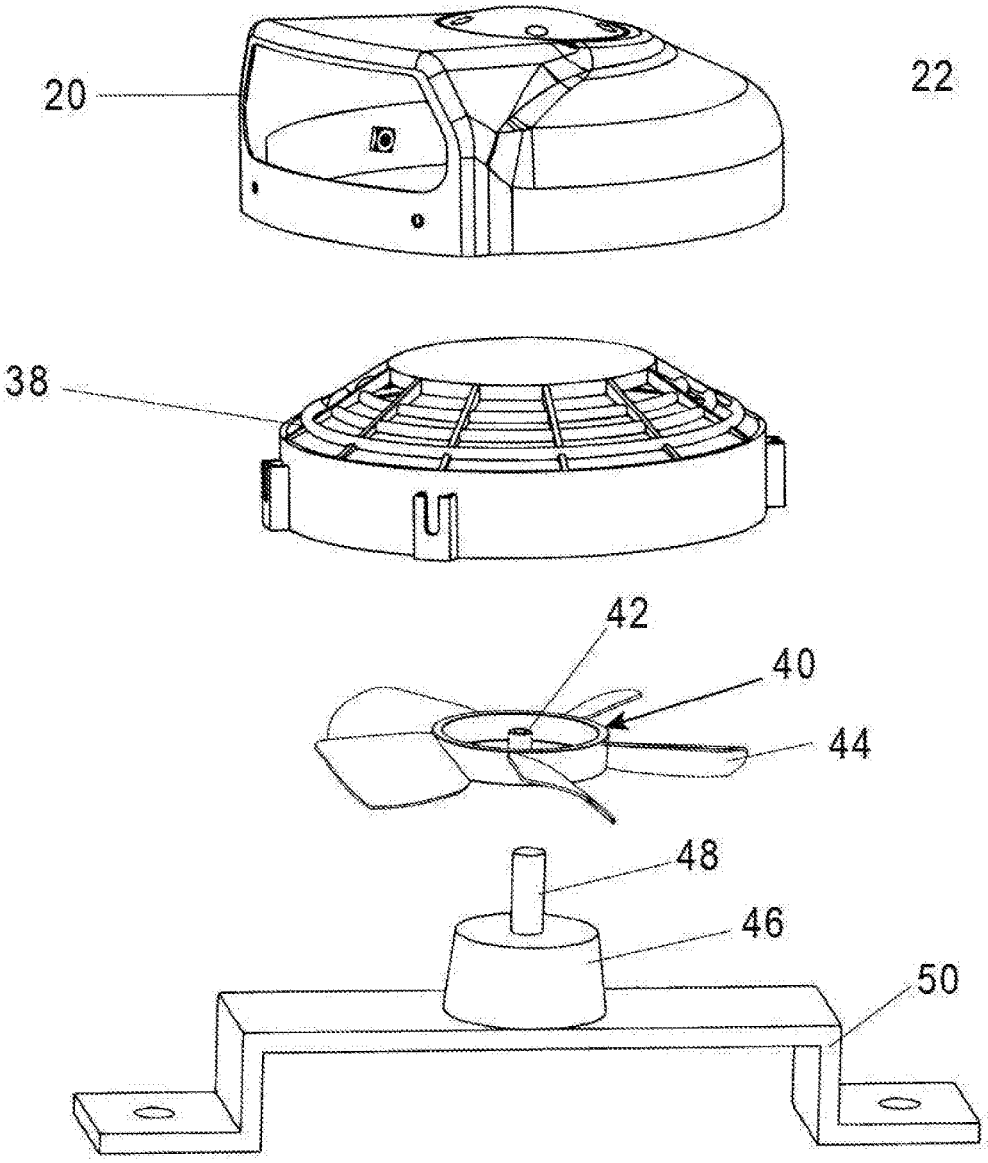
FIG. 5 is an exploded perspective view of a motorcycle cooler assembly.

FIG. 5 shows an exploded view of some of the parts of an example of a motorcycle cooler. In one effective embodiment of the design, a bracket 50 is affixed between and spanning the cylinder assembly 26 and cylinder assembly 30. Onto the bracket 50 is affixed a motor 46 having a shaft 48. Onto the shaft 48 is operatively connected a fan 40 through the center 42 so that the blades 44 on the fan 40 can operate to selectively move air when the motor 46 is powered.

A screen 38, or other debris filtering device, is also affixed to the bracket 50 over the fan 40. The screen 38 protects the fan 40 and blades 44 from damage from ingested foreign objects. The screen 38 can also protect from personal injury by inadvertent contact with the blades 44. The screen 38 is generally rigid and made from a durable material, such as metal or plastic. The screen 38 should not inhibit airflow through the motorcycle cooler in either direction.

A rigid housing 22 is also affixed to the bracket 50 providing the first line of protection of the fan 40, motor 46, screen 38 and other internal components of the motorcycle cooler. The housing 22 is preferably made from a rigid and durable material, such as metal, plastic, carbon fiber or fiberglass. The housing 22 may optionally include a decorative feature or badge on the visible, exterior surface.

The housing 22 on a forward side has a port 20. The port 20 is located at a forward end of the airflow path 32. The dimensions of the port 20 are commensurate with the volume capability of the fan 40 assembly. The port 20 dimension should be such that when the fan 40 is actuated there is sufficient restriction to speed the air passing through in a nozzle effect but sufficiently open to prevent substantial airflow restriction limited the throughput of the fan 40. In other words the fan 40 should be able to blow hot air though the port 20 with sufficient speed and force to eject that air out of the motorcycle cooler and forward, away from the rider.

The cylinder assembly 26 has a series of fins 24 and the cylinder assembly 30 has a series of fins 28. Head 34 covers cylinder assembly 30. Head 36 covers cylinder assembly 26. The fins 24 and 28 provide for an increased surface area over which the air passes thereby increasing the amount of heat energy that can be extracted from the motor 18.

Without the motorcycle cooler, while the bike is in forward motion, air flows through the fins 28 and then over fins 24 convectively cooling the cylinder assemblies 26 and 30. When the bike is stopped with the engine running the heat generated by the engine 18 is not blown away from the bike but instead tends to radiate heat into the rider rather than convecting the heat away from the rider from wind blowing through the fins 24 and 28 while in motion.

Figure 4:
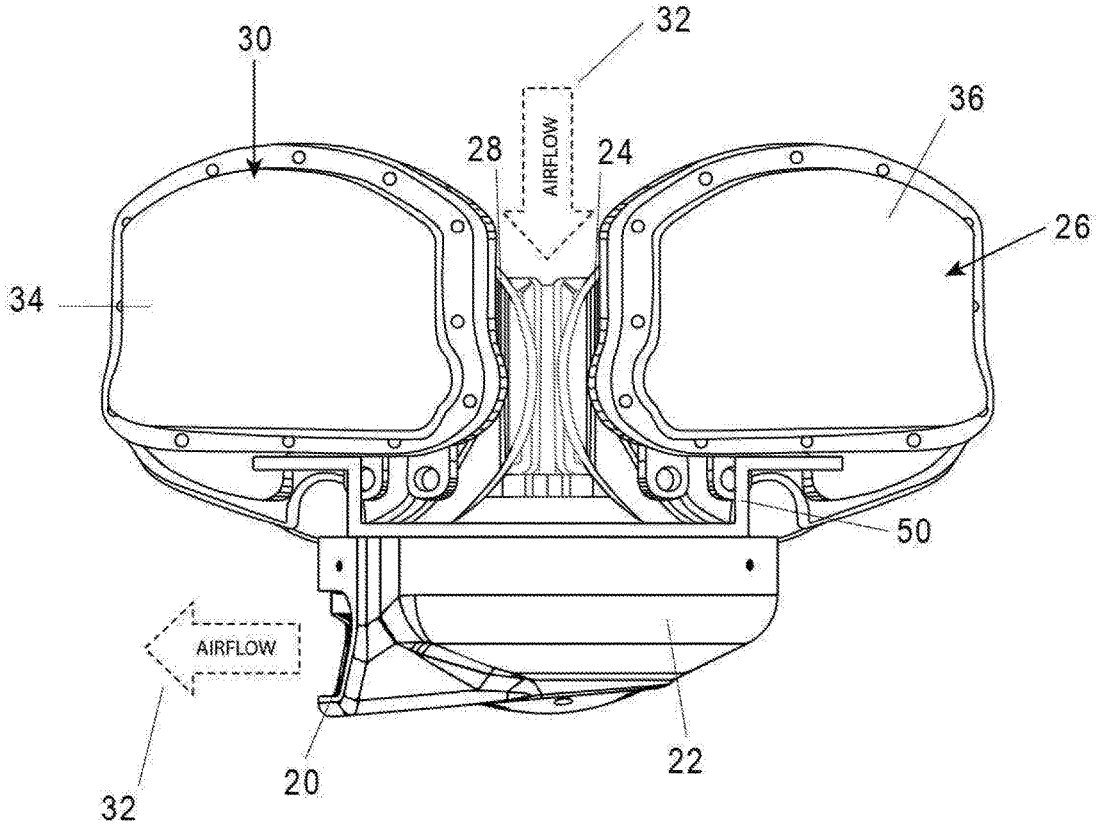
FIG. 4 is shows a plan view cross section of a motorcycle cooler installed on a motorcycle engine.

When the motorcycle cooler is installed between the cylinder assembly 26 and cylinder assembly 30 and the motorcycle is in forward motion, as in normal road use, the port 20 acts as an air scoop grabbing air and ducting the air between the cylinder assemblies 26 and 28 thereby increasing the efficiency of the air cool system. Note that the flow of air is opposite the airflow path 32 shown in FIG. 4 because the fan 40 is not in operation when the bike is moving forward.

In contrast, when the bike stops, for example at a red light, the rider can activate the fan 40 by turning on switch 16 to electrically power the motor 46 and the connected fan 40. The fan 40 then pulls air from between the cylinder assemblies 26 and 30 and forcefully ejects the then heated air forward through the port 20 away from the rider and towards the front of the motorcycle in the flow direction indicated in FIG. 4. When the rider again wishes to accelerate the motorcycle the switch 16 is turned off, turning the fan 40 off and allowing airflow to again enter the port 20 and flow through the cylinder assemblies 26 and 30.

When the motorcycle is in motion the rider and engine are both exposed to the passing air and there are reduced risks of heat injury from to motor to the rider. However, at rest the heat from the motor could injure the rider and then the fan 40 blowing the engine heat forward away from the rider is preferred for comfort and safety.

The switch 16 can optionally be integrated into the speedometer or transmission of the motorcycle to automatically turn the fan 40 on when the bike is running but stopped. Then as the bike accelerates the switch 16 can automatically turn the fan 40 off and allow the port 20 to accept air and allow airflow through the motorcycle cooler and past the fins 24 and 28 to cool the motor 18. The switch 16 could have selections for on, off and automatic control of the fan 40.

The drawings show the motorcycle cooler on the left side of the bike between the cylinder assemblies 26 and 30. It is equally usable, and preferred on some makes and models of bikes, to simply move the motorcycle cooler to the right side of the bike, keeping the port 20 facing towards the front of the boke.

Motorcycle V-twin air cooled engines rely on a flow of air over an engine with fins. The fins receive fresh air and cool the motorcycle engine at a good temperature when riding at normal speed on the road. Summer time when temperature get very hot especially in Florida driving in city traffic and highway is very difficult when normal speed is not reach. The engine temperature gets high with very low air flow. The motorcycle engine can run too hot and the drivers' legs receive the extreme heat caused by the engine.

The engine runs at a good temperature generally between about 200 degrees Fahrenheit (F) and about 250 F. When engine temperatures get over about 250 F, typically risked at idle, the oil pressures drops almost to zero and may cause some mechanical problems due to the overheating. Problems can include low mileage fuel efficiency and cause more maintenance from increased engine wear.

Some prior art uses a pushing fan to cool the motorcycle engine but this can create another problem: the fan can push the air flow through the engine making the air flow very hot and directed at the riders right leg causing discomfort at best and severe burns likely because the air can rise to between about 250 F to 400 F or more.

In the prior art there is no solution for both problems: cooling the engine and keeping the heat away from the rider's right leg. This invention allows the engine to get fresh air flow using one electrical pulling fan to cool the motorcycle engine by capturing and redirecting the air flow away from the right leg by using a fan and ducted cover. With this system, the motorcycle driver can now be very comfortable. The motorcycle engine at idle remains at a good temperature and it will not cause any damage or significant engine friction wear to the motorcycle engine. The engine will require less maintenance, will provide longer motorcycle engine life time (in mileage) and most importantly it will avoid overheating the driver's right leg while protecting the right leg from the heated air and making the drive in the city and the highway very pleasant and comfortable.

This invention allows the engine to get fresh air flow using one electrical pulling fan to cool the motorcycle engine and redirect the air flow away from the right leg using a special redirect (ducting) fan cover.

This invention is using at least one powerful electrical fan to cool the motorcycle engine and redirect the air flow away from the legs using a specially ducted fan cover to bi-directionally control airflow through the device and the cylinder fins, selectively on command. The motorcycle's fan is installed on the side of the V-twin motorcycle between cylinder one and cylinder two using a fan bracket. The fan is connected to the motorcycle accessories fuse box using an appropriately sided amp fuse connector included with the wiring harness fan for power. The fan cover is then ready to be installed to the fan using screws and nuts. When the fan is on the air flow is going through the engine from the right side to the left side and forward away from the driver's legs.

In at least one effective version of the device, and merely for an example, the fan motor is twelve volt to integrate with the wiring system of the motorcycle. The fan can produce about two hundred to eight hundred cubic feet per minute for most bikes. However, the size and performance of the fan may be adjusted for the particular bike and configuration. Simple testing with a thermometer and using the bike can yield the recommendation for fan power above or below that stated range of air movement.

An important version of the inventive concept can be fairly described as a motorcycle engine cooler comprised of a bracket, a fan, a switch, a screen and a cover. The bracket is affixed to a side of an air cooled motorcycle engine over a cooling fin on the cylinder to aid in ducting the direction of airflow to cool the engine and rider. The fan is affixed to the bracket oriented such that when the fan is operated air is drawn past the cooling fin away from the motorcycle engine, as opposed to pushing outside air over the cooling fins. The screen is affixed to the bracket and covers the cooling fan without substantially restricting airflow. In some installations, the screen is not needed and can be removed. The cover is affixed to the bracket and covers the screen and the fan to protect the internal components and to aid in directing airflow. The cover has a port that is oriented towards a front side of the motorcycle to direct airflow generated by the fan forward away from the driver when the fan is on and can scoop air and direct it over the cylinder fins when the fan is off and the bike is in forward motion. When the motorcycle is in a forward motion a passing air enters the port and the cover directs the passing air over the cooling fins and cylinders. The switch is operatively connected to the fan and an electrical system integral to the motorcycle and powered by the onboard battery or other available power supply. When the motorcycle is stopped and a the switch is operated to turn on the fan causing an ambient air to be drawn over the fin and expelled through the port towards the front side of the motorcycle. In some versions of the device, when the motorcycle stops the motorcycle rider operates the switch to turn the fan on and when the motorcycle is in the forward motion the motorcycle rider operates the switch to turn the fan off. Optionally, the fan is by default off and the switch automatically activates the fan when the motorcycle is stopped. The switch can have an on/off mode for manually turning the fan on and off and an automatic mode that turns the fan on automatically when the bike is hot and stopped.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

INDUSTRIAL APPLICABILITY

It is evident that an invention such as a motorcycle engine cooler, in any of its encompassed iterations, is desirable because it can help the motorcycle rider avoid excessive heat generated by the engine that can cause burns or discomfort. Further, the device can aid in cooling the engine that can reduce engine wear and prolong the life of the engine.

What is claimed is:

1. A motorcycle engine cooler comprised of a bracket, a fan, a switch, a screen and a cover;

the bracket is affixed to a side of an air cooled motorcycle engine over a cooling fin;

the fan is affixed to the bracket oriented such that when the fan is operated air is drawn past the cooling fin away from the motorcycle engine;

the screen is affixed to the bracket and covers the cooling fan without substantially restricting an airflow;

the cover is affixed to the bracket and covers the screen and the fan;

the cover has a port that is oriented towards a front side of the motorcycle;

when the motorcycle is in a forward motion the fan is off and a passing air enters the port and the cover directs the passing air over the cooling fin;

the switch is operatively connected to the fan and an electrical system integral to the motorcycle;

when the motorcycle is stopped and the switch is operated to turn on the fan causing an ambient air to be drawn over the fin and expelled out through the port towards the front side of the motorcycle and away from a driver when sitting on the motorcycle.

2. A method of cooling a motorcycle engine comprising the motorcycle engine cooler in claim 1 further characterized in that when the motorcycle stops a motorcycle rider operates the switch to turn the fan on and when the motorcycle is in forward motion the motorcycle rider operates the switch to turn the fan off.

3. A method of cooling a motorcycle engine comprising the motorcycle engine cooler in claim 1 further characterized in that the fan is by default off and the switch automatically activates the fan when the motorcycle is stopped.

* * * * *